US006264271B1

(12) United States Patent
Munn et al.

(10) Patent No.: US 6,264,271 B1
(45) Date of Patent: Jul. 24, 2001

(54) ADJUSTABLY RECLINABLE FOLDING CHAIR

(75) Inventors: Daniel C. Munn, West Branch; Robert Eastman, III, Fenton; Jeffrey Allan Pestrue, St Louis, all of MI (US)

(73) Assignee: The Game Tracker, Inc., Flushing, MI (US)

( * ) Notice: Subject to any disclaimer, the term of this patent is extended or adjusted under 35 U.S.C. 154(b) by 0 days.

(21) Appl. No.: 09/415,643

(22) Filed: Oct. 12, 1999

(51) Int. Cl.[7] ..... A47C 4/28
(52) U.S. Cl. ..... 297/45; 297/372
(58) Field of Search ..... 297/16.1, 16.2, 297/19, 30, 45, 35, 354.12, 372, 366, 374, 452.18, 423.1, 452.13

(56) References Cited

U.S. PATENT DOCUMENTS

| | | | |
|---|---|---|---|
| D. 382,414 | | 8/1997 | Lee . |
| 3,124,387 | * | 3/1964 | Maclaren . |
| 3,635,520 | * | 1/1972 | Roher et al. . |
| 4,118,065 | * | 10/1978 | Watkins . |
| 4,717,201 | * | 1/1988 | Barras . |
| 5,718,473 | | 2/1998 | Lynch . |
| 5,893,605 | * | 4/1999 | Chang . |
| 5,984,406 | | 11/1999 | Lee . |

* cited by examiner

*Primary Examiner*—Milton Nelson, Jr.
(74) *Attorney, Agent, or Firm*—Carrier, Blackman & Associates, P.C.; William D. Blackman; Joseph P. Carrier

(57) ABSTRACT

A folding chair, which is foldably collapsible in a scissors-like folding operation, forms a long narrow bundle when collapsed, which fits into a tubular bag. The folding chair includes a pivotally jointed backrest support member which can be placed in various configurations to allow reclining movement thereof. The folding chair includes a frame assembly and a flexible hammock-type of fabric seat member which is mounted on, and supported by, the frame assembly. In a preferred embodiment, the frame assembly includes a plurality of interconnected X-members. The X-members cooperate to define a cage member when the chair is in an open configuration thereof. The frame assembly further includes a position fixing mechanism for temporarily and disengagably fixing the position of the seat back, to allow the frame assembly to be temporarily locked in a particular orientation thereof. In a particularly preferred embodiment, the position fixing mechanism includes a vertically oriented rack gear attached to a vertically oriented pillar and having teeth formed therein, and a spring-loaded pawl, pivotally attached to a slidably adjustable brace, for locking placement between the teeth of the vertical rack. A foldably collapsible and removable foot rest for a folding chair is also disclosed. The foot rest may be used with folding chairs of various structural configurations, and includes at least one connector for attaching to a seat portion, and a lower reinforcement for engaging a support member on a folding chair.

17 Claims, 5 Drawing Sheets

ADJUSTABLY RECLINABLE FOLDING CHAIR

BACKGROUND OF THE INVENTION

1. Field of the Invention

The present invention relates to an adjustably reclinable folding chair, and to a removable foot rest which may be fitted thereon, or on a different folding chair. More particularly, the present invention relates to a folding chair, of a type which folds with a scissors-like folding action, which includes a pivotally jointed backrest support member which can be placed in various configurations to allow reclining movement thereof.

2. Description of the Background Art

Many different types of folding chairs are known and are commercially available. Examples of two known folding chairs, of a general type which folds with a scissors action to give a compact, vertically oriented bundle when folded, may be found in U.S. Pat. Nos. D382,414, and 5,718,473. Other chairs of this scissors-type folding action are commercially available, but it is the present applicant's understanding and belief that none of the known folding chairs of the scissors-folding type include a reclining back feature, nor are any of the known folding chairs believed to have a removable foot rest. Some foldable deck chairs, which have adjustable reclining backs, are also known.

While multiple designs for foldably collapsible chairs are known, a need still exists in the art for an adjustably reclinable folding chair with a back support section which may be temporarily and disengagably fixed in a number of different positions, yet which may be folded in a scissoring action to form a compact bundle, to take up less space than the known adjustably reclinable folding chairs. A need also exists for a removable foot rest which may be used with a folding chair.

SUMMARY OF THE INVENTION

The present invention provides a folding chair, which is foldably collapsible in a scissors-like folding operation, to form a long narrow bundle which fits into a tubular bag when collapsed.

A folding chair in accordance with the present invention, generally, includes a frame assembly and a hammock-type flexible fabric seat member which is mounted on, and supported by, the frame assembly. Optionally, the chair may include a removable foot rest and/or integral arm rests.

In a preferred embodiment of the invention, the frame assembly includes a plurality of interconnected X-members. Each of the X-members includes a pair of bars which are medially pivotally joined to one another. Together, the X-members cooperate to define a cage-like structure for supporting the fabric seat member.

The preferred embodiment of the frame assembly also includes at least one pillar, operatively attached to the cage-like structure, for substantially vertical placement when the chair is in the open configuration thereof, and a backrest support bar which is pivotally attached to the upper end portion of the pillar. The backrest support bar is placeable in linear relation to the pillar when the chair back is placed into a filly upright position.

The frame assembly still further includes position fixing means for temporarily and disengagably fixing the position of the backrest support bar relative to the pillar, to allow the frame assembly to be temporarily locked in a selected orientation thereof.

In a particularly preferred embodiment, the position fixing means includes a brace having a first end which is pivotally attached to a first member selected from a target group consisting of the backrest support bar and the pillar, and a second end which is slidably movable along the other, second member of the target group, in response to pivotal movement of the backrest support bar.

In a preferred embodiment of the invention, the second end of the brace is preferably pivotally attached to an exterior portion of a hollow sleeve which surrounds the second member of the target group, and which is slidably moveable thereon. Where used, the sleeve is also preferred to include a plastic liner therein, which functions as a bushing to facilitate slidable movement of the sleeve on the second target member.

The position fixing means is also preferred to include a vertically oriented rack gear attached to the first target member and having teeth formed therein, and a spring-loaded pawl, which is pivotally attached to the sleeve, the pawl including a pointed end portion for temporary locking placement between adjacent teeth of the vertical rack.

Accordingly, it is an object of the present invention to provide a folding chair having an adjustably reclinable back support section when open, yet which may be folded in a scissoring action to take up a small amount of space when folded.

It is another object of the present invention to provide an adjustably reclinable folding chair of the type described, which may be placed into a long, narrow bundle when folded, which fits into a tubular bag for storage and/or transport.

It is a further object of the invention to provide a removable foot rest which may be used with the chair hereof, or which may, alternatively, be used with other folding chairs.

For a more complete understanding of the present invention, the reader is referred to the following detailed description section, which should be read in conjunction with the accompanying drawings. Throughout the following detailed description and in the several views of the drawings, like numbers refer to like parts.

DETAILED DESCRIPTION OF THE PREFERRED EMBODIMENTS

A. Overview

Figure 1:
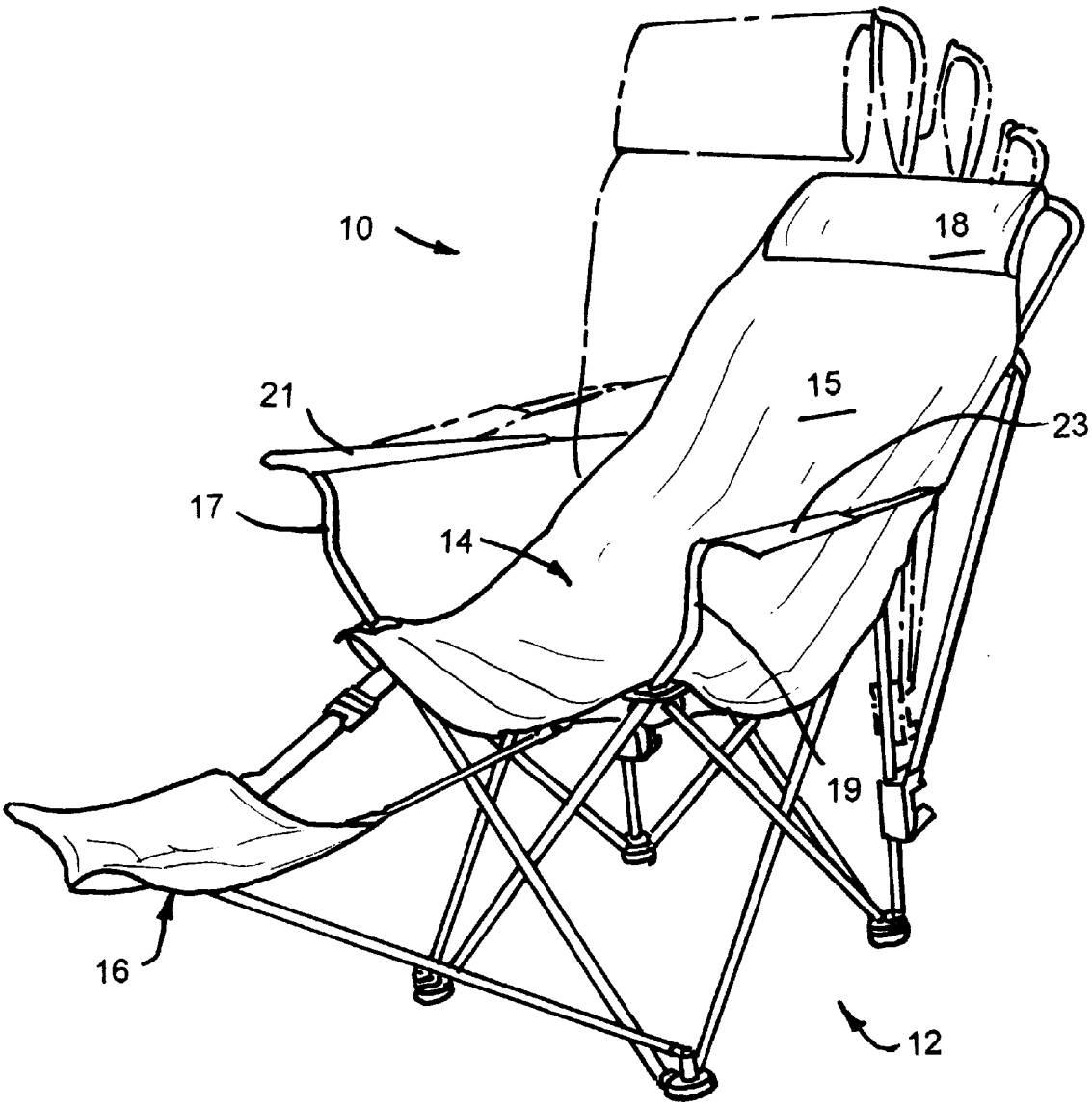
FIG. 1 is a perspective view of a folding chair in accordance with a preferred embodiment of the present invention, drawn from a vantage point in front of the chair, showing an upright position of the chair in phantom, and showing a fully reclined position of the chair in solid lines.

Referring now to FIG. 1 of the drawings, the present invention provides a folding chair 10, which is foldably collapsible in a scissors-like folding operation, from an open configuration thereof, for supportively receiving a seated person therein, to a closed and folded configuration thereof (not shown), to form a long narrow bundle which fits into a tubular bag. (Those in the relevant art will understand how the chair is foldably collapsible from a review of the frame structure shown in FIG. 2.) The chair 10, in accordance with the preferred embodiment of the invention, includes a back support section 15 which is adjustably reclinable, from a fully upright position shown in phantom in FIG. 1, through a series of intermediate reclined positions, to the fully reclined position shown in solid lines.

The chair 10 includes a frame assembly 12, and a hammock-type flexible fabric seat member 14 which is mounted on, and supported by, the frame assembly. In the preferred embodiment hereof, as shown in FIG. 1, the chair 10 also includes a removable foot rest 16 which is shown connected to the frame assembly 12 and also to the seat member 14. Each of these primary components will be discussed in further detail hereinbelow.

As used throughout the present specification, relative positional terms like "upper", "lower", "above", "below", and the like are used in reference to the orientation of the chair 10 in the fully opened configuration shown in FIG. 1, which is the preferred operational orientation thereof. It will be understood, however, that the chair 10 could be turned on its side, inverted, or foldably collapsed into a storage orientation thereof; and if so turned, inverted, or folded, these positional terms would no longer apply. These terms are used for illustrative purposes to assist the reader in understanding the structure of the illustrated embodiment, and are not intended to limit the invention.

B. The Frame Assembly

Figure 2:
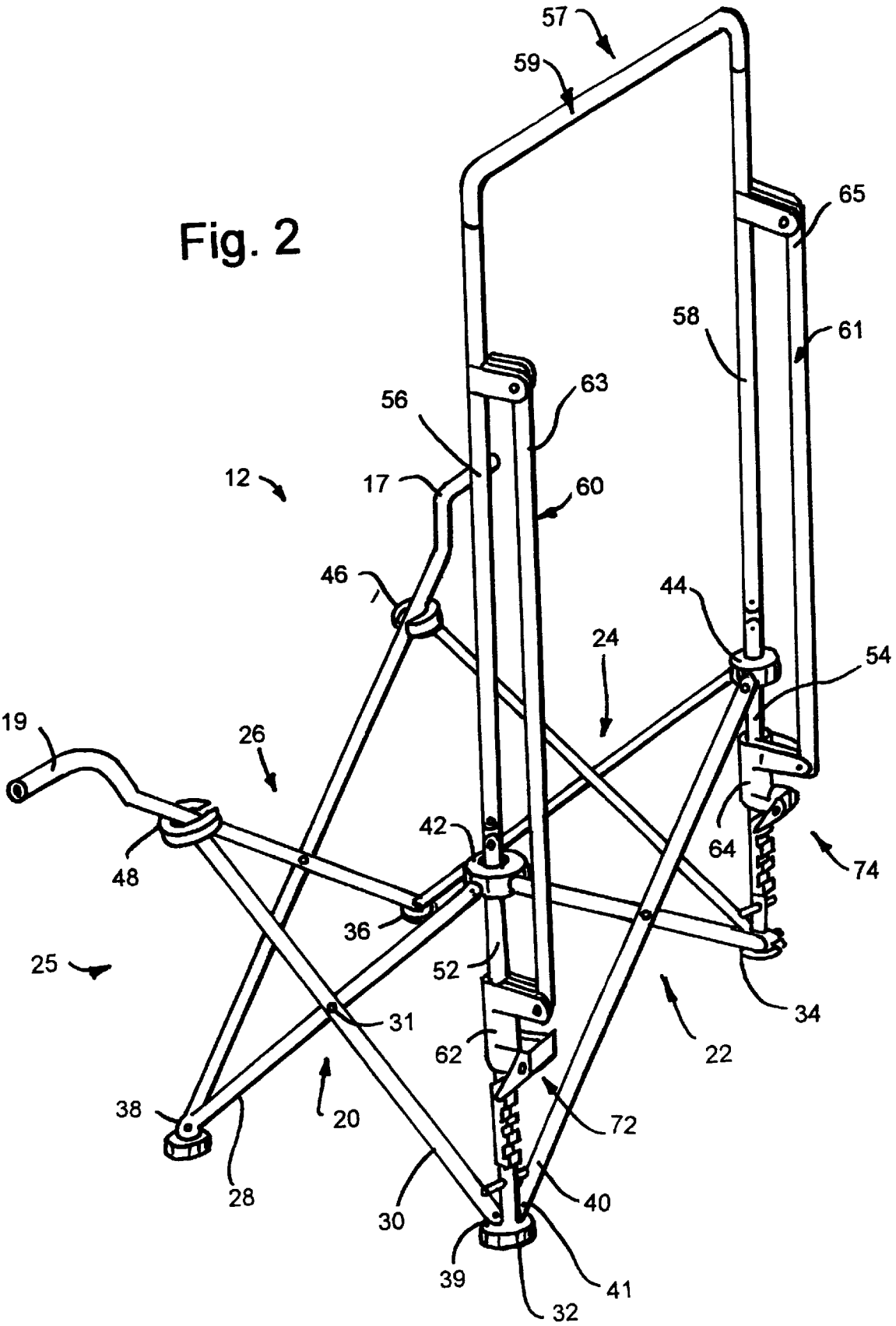
FIG. 2 is a perspective view of a frame assembly which is a part of the chair of FIG. 1, drawn from a vantage point behind the chair, with the foot rest removed therefrom.

Referring now to FIG. 2 of the drawings, the frame assembly 12 is shown with the seat member 14 and the foot rest 16 removed therefrom for purposes of clarity of illustration. The frame assembly 12 is preferably formed out of aluminum, steel, or strong plastic tubing, and preferably out of hollow tubing of any of these materials. Alternatively, the frame assembly may be made out of flat bars of the above materials.

The frame assembly 12 includes a plurality of X-members such as, for example, the first, second, third, and fourth X-members 20, 22, 24, and 26, respectively, shown in FIG. 2. The X-members are interconnected, as shown, in a manner to be further described herein. The X-members cooperate to define a substantially cubic cage-like structure when the chair 10 is in the open and unfolded configuration thereof. For purposes of brevity and simplicity in the present discussion, this cage-like structure will be referred to as the cage 25. The frame assembly 12 may, optionally, further include armrest support rails 17, 19 which are integrally formed continuations of the two bars making up the fourth X-member 26 at the front of the chair 10.

Each of the X-members 20, 22, 24, and 26 includes a pair of bars, such as for example the bars 28, 30 making up the first X-member 20. These bars 28, 30 are medially pivotally joined to one another by a rivet 31, or other suitable fastener, for supporting the seat member 14 thereon. (As used herein in relation to the bars making up the X-members, the term "medial" is intended to mean located between the end portions of the bars.)

Alternatively, in a modified embodiment (not shown), the bridge piece 59 could be made in two pieces so as to be foldable in the center thereof, and could then be pivotally attached to the upper ends of the backrest support bars 56, 58.

The frame assembly 12 also includes first, second, third and fourth feet 32, 34, 36, 38, respectively, with one foot at each of the bottom four corners of the cage 25, for supportively connecting adjacent lower ends of the X-members. Each of the feet 32, 34, 36, 38 has two adjacent lower bar ends of selected X-members pivotally attached thereto. For example, a lower end of a first bar 30 of the first X-member is pivotally attached to the first foot 32, at a first pivotal attachment 39 thereon, and a lower end of another different bar 40 of the second X-member 22 is also attached to the first foot, at a second pivotal attachment 41 thereon.

The first and second feet 32, 34 respectively define left and right lower rear corners of the cage 25, and the third and fourth feet 36, 38 respectively define right and left lower front corners of the cage, when it is in its unfolded and open configuration.

The frame assembly 12 further includes first, second, third and fourth connector members 42, 44, 46, and 48, respectively, at the top four corners of the cage 25, for supportively connecting adjacent upper ends of the X-members. Each of the connector members has two adjacent upper bar ends of selected X-members pivotally attached thereto, in a manner similar to the way that the feet connect adjacent lower bar ends. Each of the first, second, third and fourth connector members 42, 44, 46, and 48 is disposed over and above its correspondingly numbered foot 32, 34, 36 or 38 when the chair is in its unfolded configuration, as shown.

The first and second connector members 42, 44 each have a hollow cylindrical bore formed substantially vertically therethrough, to allow slidable vertical movement thereof on respective opposed pillars 52, 54 and associated backrest support bars 56, 58, in order to facilitate collapsible folding of the chair 10.

The frame assembly 12 further includes at least one pillar such as the first pillar 52 which is fixedly attached to the first foot 32 and extends upwardly therefrom, for substantially vertical placement when the chair 10 is in the opened configuration thereof. While a single central vertical pillar could be used and would be within the scope of the present invention, in the preferred embodiment hereof, first and second pillars 52, 54 are provided at the rear corners of the cage 25.

In the depicted embodiment, the first pillar 52 passes freely and non-interferingly through the cylindrical bore of the first connector member 42.

Similarly, in the preferred embodiment, a second pillar 54 is rigidly attached to the second foot 34, and extends upwardly therefrom for substantially vertical placement when the chair is in its opened configuration. The second pillar 54 passes freely and non-interferingly through the cylindrical bore of the second connector member 44.

The frame assembly 12 still further includes at least one backrest support bar such as the first backrest support bar 56 pivotally attached to the top of the first pillar 52 and extending upwardly therefrom. The preferred embodiment also includes a second backrest support bar 58 pivotally attached to the top of the second pillar 54 in a similar fashion.

The first and second backrest support bars 56, 58 may be formed as opposed legs of an inverted U-shaped member 57, as shown, in which the support bars are interconnected by a horizontal bridge piece 59 for added strength and reinforcement. Where used, the U-shaped member 57 is preferably made out of a plurality of separate component pieces which are telescopically or otherwise disconnectably assembled, with the bridge piece 59 being separably removable from the backrest support bars 56, 58 to allow for folding of the chair 10. Where a solid bridge piece 59 is used, the chair 10 cannot be folded with the bridge piece in place, and the bridge piece must be removed to fold the chair.

Alternatively, in a modified embodiment (not shown), the bridge piece 59 could be made in two pieces so as to be foldable in the center thereof, and could then be pivotally attached to the upper ends of the backrest support bars 56, 58.

The frame assembly 12 also includes at least one position fixing means for temporarily and disengagably fixing the position of the backrest support bars 56, 58 relative to the first and second pillars. In the preferred embodiment, each side of the frame assembly 12 is provided with a position fixing means, with a first position fixing means 72 on the first pillar 52, and a second position fixing means 74 on the second pillar 54.

The first and second position fixing means 72, 74 work in the same way, so a description of the workings of the first position fixing means 72 will be sufficient.

The frame assembly 12 yet further includes at least one brace 60, and preferably includes first and second braces 60, 61, for reinforcingly interconnecting the first and second backrest support bars 56, 58 to the respective first and second pillars 52, 54. Each of the braces 60, 61 has an upper end 63, 65, respectively, which is pivotally attached to the respective first or second backrest support bar 56 or 58, and a lower end which is slidably movable along the pillar in response to pivotal movement of the backrest support bar. In the preferred embodiment of the invention, the lower end of each brace 60, 61 is pivotally attached to a hollow cylindrical sleeve 62, 64, respectively.

Figure 3C:
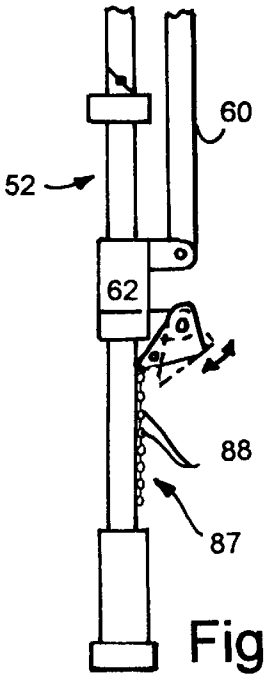
FIG. 3C is a detail view, partially cut away, of a position fixing mechanism, which is a part of the frame assembly section of FIG. 3A.
Figure 3B:
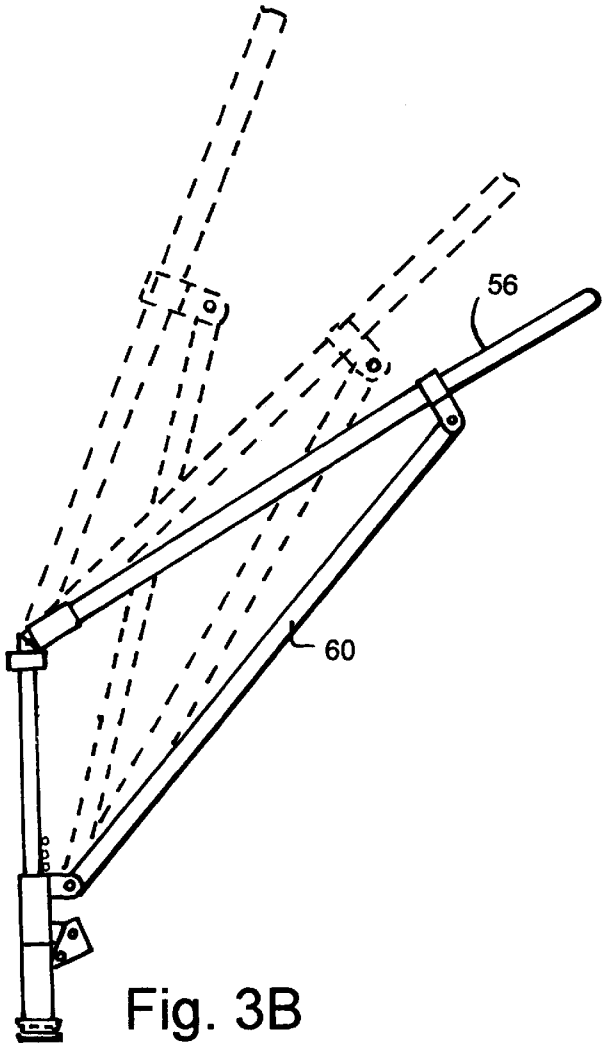
FIG. 3B is a side plan view of the frame assembly section of FIG. 3A, showing a sequence of intermediate reclined positions thereof in phantom, and showing a fully reclined position thereof in solid lines.
Figure 3A:
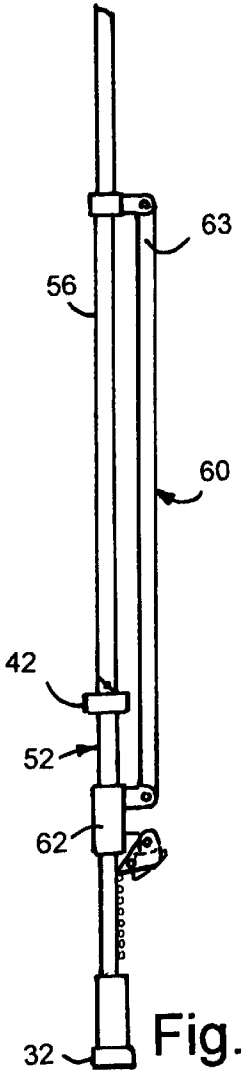
FIG. 3A is a side plan view of a section of the frame assembly of FIG. 2, shown in a fully upright position of the chair.

Referring now to FIGS. 3A and 3B, it will be seen that as the first backrest support bar 56 pivots rearwardly about its connection to the top of the first pillar 52, the top of the upper end 63 of the brace 60 remains attached to the same point thereon yet moves pivotally outwardly with respect thereto. At the same time, the first sleeve 62 is pivotally attached to the bottom end of the first brace 60, but is free to slidably move downwardly on the first pillar 52, as necessary to allow the downward movement of the lower end of the first brace 60, to accommodate the outward reclining movement of the backrest support bar 56.

Figure 4:
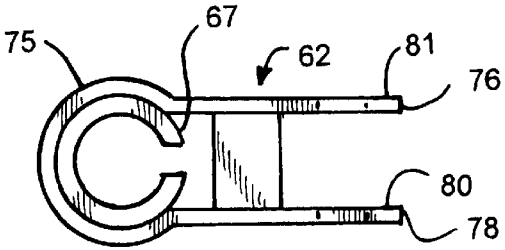
FIG. 4 is a top plan detail view of a sleeve, and optional liner therefor, which are components of the position fixing mechanism of FIG. 3C.
Figure 5:
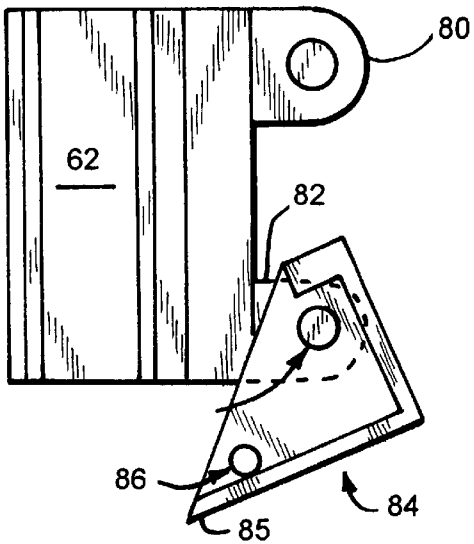
FIG. 5 is a side plan view of the sleeve of FIG. 4, also showing a pawl attached thereto, which is another component of the position fixing mechanism of FIG. 3C.

As noted, the bottom end of the first brace 60 is preferably pivotally attached to a first sleeve 62 which is slidably mounted on the first pillar 52. As best seen in FIGS. 4 and 5, the sleeve 62 includes a semi-cylindrical portion 75 which is substantially C-shaped in cross section, and also includes a pair of parallel spaced apart integral vertical side flanges 76, 78 extending outwardly from the semi-cylindrical portion. Each of the side flanges 76, 78 includes upper and lower integral pivot bosses 80, 82 thereon. The lower end of the first brace 60 is pivotally attached between the upper pivot bosses 80, 81 (FIG. 4) in conventional fashion, and a pawl 84 (FIGS. 3C and 5) is similarly pivotally attached on the outside of the lower pivot bosses 82. A spring is provided to bias the tip end 85 of the pawl 84 into the first pillar 52, which is counterclockwise as viewed from the vantage point of FIGS. 3C and 5. Optionally, a graspable post 86 may be provided extending outwardly on the pawl 84 to facilitate grasping thereof by a user of the chair 10.

The position fixing means also includes a vertically oriented rack gear 87, attached to the first pillar 52, and the rack gear 87 is provided with a plurality of outwardly extending teeth 88 formed therein, and spaces formed between the teeth 88.

In order to recline the chair backrest support, the pawl 84 must be moved, against the biasing force of the spring, away from the pillar 52. Then, the backrest support bar 56 may be tilted rearwardly, as shown by the progressive phantom images thereof in FIG. 3B, until a specific preferred orientation thereof is selected. The sleeve 62 slides progressively down the pillar 52, pushed by the brace 60 as the backrest support bar 56 is pivoted backward, and when the preferred orientation is reached, the pawl 84 is released and the tip end 85 thereof lodges between two of the teeth 88 of the rack gear 87, to temporarily lock the chair backrest support bar 56 in the selected orientation thereof.

As long as there is weight of a person in the chair leaning backward to keep downward pressure on the sleeve 62, so that the pawl tip 85 remains wedged between the teeth 88, the chair will remain in the selected reclined position thereof. However, when the user sits up and leans forwardly, the downwardly pressing weight on the seat supporting portion of the seat member 14, coupled with reduced pressure on the sleeve 62, tends to automatically return the backrest support bar to an upright configuration, and because of its shape and angled placement relative to the gear teeth 88, the pawl 84 is able to slidably move past the gear teeth on upward movement of the sleeve 62.

The sleeve 62 is preferably provided with a plastic liner 67, which acts as a bushing to facilitate sliding movement of the sleeve 62 up and down the first pillar 52.

C. The Seat Member

As previously noted, the fabric seat member 14 is mounted on and supported by the frame assembly 12. The seat member 14 is preferred to include a hollow passage formed in the top end thereof to receive the bridge piece 59 therein. The hollow passage at the top of the seat member 14 is preferably formed by folding the material of the seat member over, and sewing it back on itself. The seat member 14 may further include a foam pillow insert 18, sewn or placed inside a pocket provided therefor at the upper end thereof.

The seat member 14 is attachable to the frame assembly 12 in any suitable fashion, such as by having reinforced holes formed therethrough which fit over the arm support rails 17, 19, and which are too small to pass over the third and fourth connector members 46, 48. In addition, the back support portion 15 of the seat member 14 may have vertically oriented side sleeves (not shown) formed therein, to slidably fit over the backrest support bars 56, 58.

The seat member 14 may also include fabric arm rests 21, 23 which are attached, at the outer ends thereof to the armrest support rails 17, 19 and which are also sewn, at the inner ends thereof, to the main body of the seat member.

D. The Foot Rest

The present invention also encompasses a removable foot rest 16 for a folding chair. The foot rest 16 hereof may be used as one component of the preferred embodiment of the chair 10 as previously described. In addition, the foot rest 16 hereof may be used with other folding chairs, and may be adapted specifically to be compatible with other folding chair designs.

Figure 8:
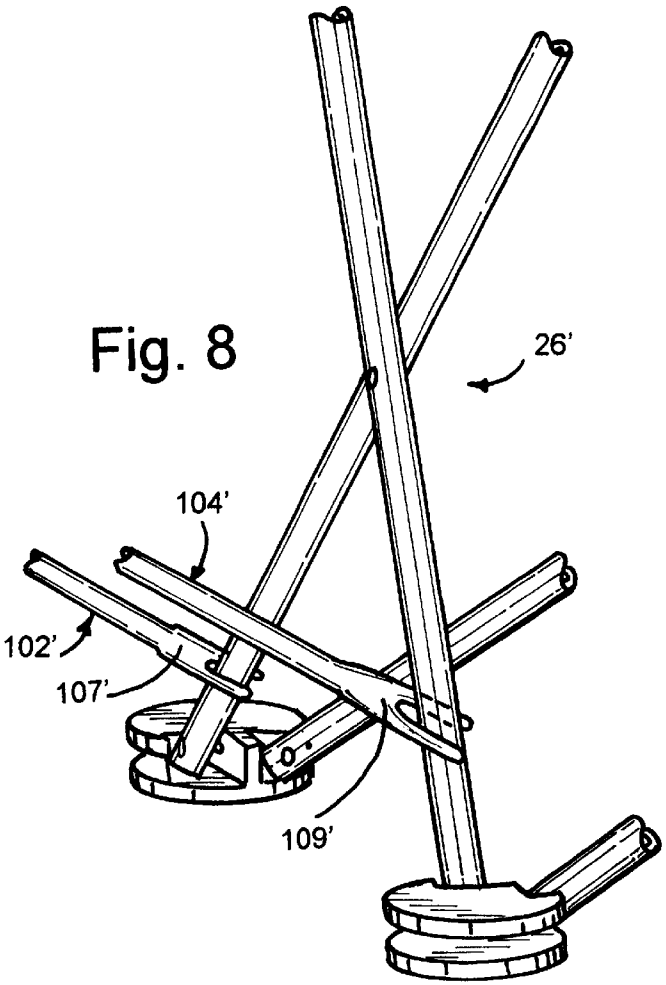
FIG. 8 is a perspective detail view, partially cut away, of an alternative second possible connection between the support legs of the foot rest and the frame structure.
Figure 6:
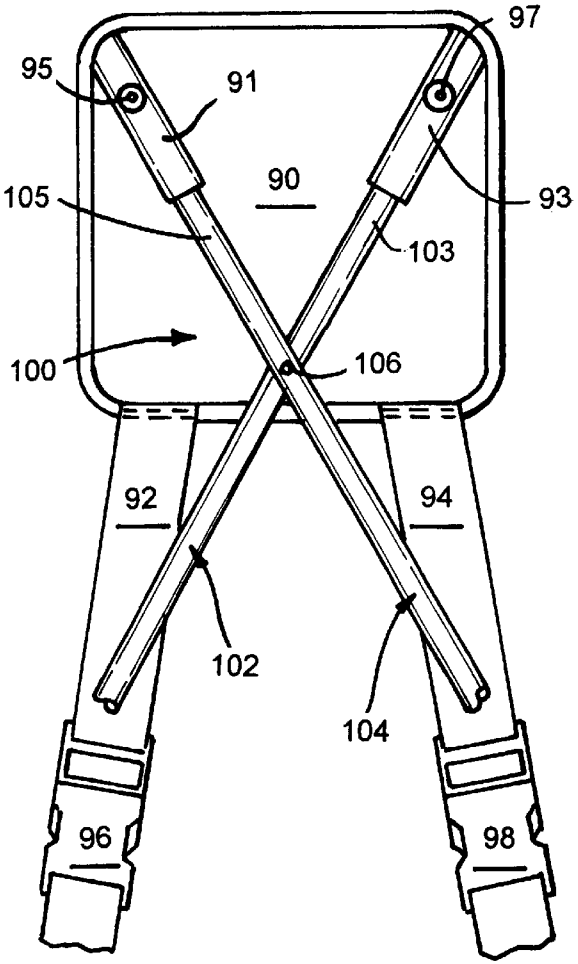
FIG. 6 is a bottom plan view, partially cut away, of a detachable foot rest in accordance with the invention.
Figure 7:
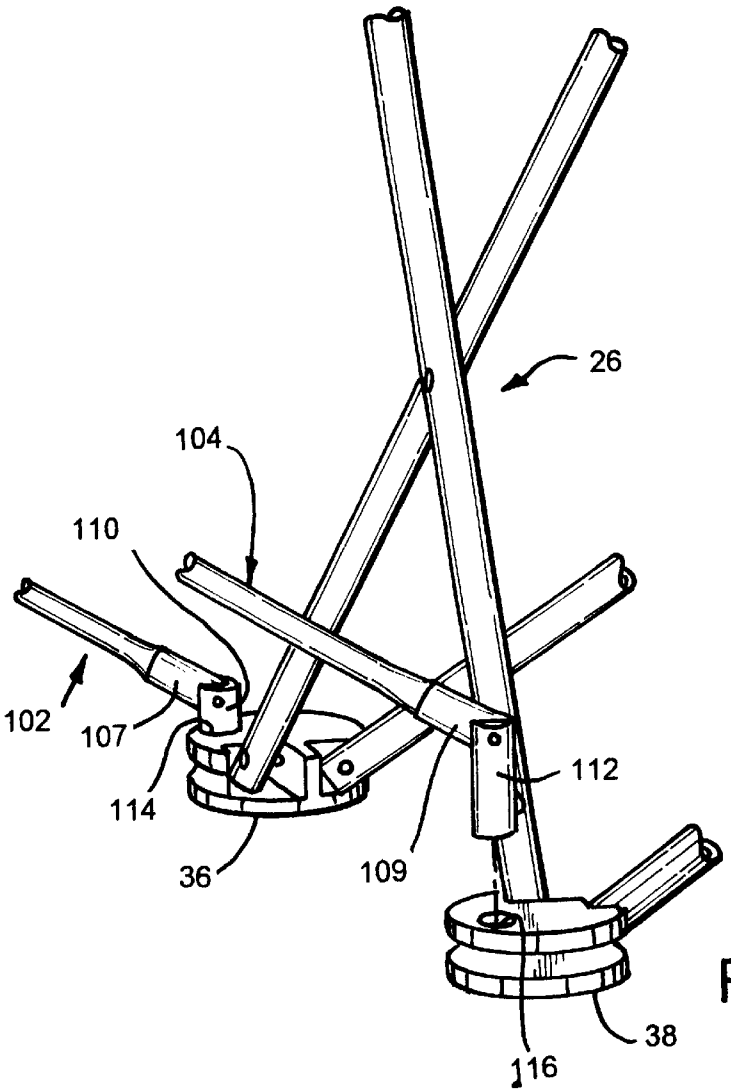
FIG. 7 is a perspective detail view, partially cut away, of a first possible connection between the support legs of the foot rest and the frame structure.

Referring now to FIGS. 6–8, a removable foot rest according to the present invention includes a foot rest panel 90 for providing a resting place for feet of a user. The foot rest panel 90 is preferably made of the same fabric as the seat member 14, but may alternatively be made of a solid material such as wood or plastic. The foot rest hereof also includes means for operatively connecting the foot rest panel to a folding chair. Preferably, the connecting means includes at least one, and preferably two straps 92, 94, each having a disconnectable latching mechanism therein, such as, for example, the plastic spring clip connectors 96, 98 shown in the drawing, or standard buckles, or a hook and loop type of fastener.

The foot rest 16 according to the invention also includes a support structure 100 for supporting the foot rest panel. The preferred support structure for the foot rest 16 includes first and second footrest support bars 102, 104 which are pivotally connected to one another at respective medial portions thereof by a rivet 106 or other conventional fastener. Each of the footrest support bars 102, 104 has an outer end 103, 105, respectively, which is operatively connected to the foot rest panel, and an inner end 107, 109, respectively, (FIG. 7) for attachment to structural base portions of a folding chair.

The outer ends of the support bars 102, 104 are attachable to the foot rest panel 90, and this may be accomplished in any suitable way. In the depicted embodiment of FIG. 6, a pair of hollow sleeves are provided on the bottom surface of the foot rest panel 90, and the outer ends 103, 105 of the footrest support bars 102, 104 slidably fit therein. If desired, the footrest support bars 102, 104 may be affixed to the sleeves 91, 93 by suitable fasteners 95, 97.

In the embodiment of FIG. 7, the inner ends 107, 109 of the footrest support bars have cylindrical plugs 110, 112 pivotally attached to the ends thereof. The third and fourth feet 36, 38 may have vertical cylindrical bores 114, 116 formed therein, as shown, to engagingly receive the plugs 110, 112 of the footrest support bars.

Referring now to FIG. 8, an alternative structure is shown for attaching the footrest support bars 102', 104' to structural base portions of a folding chair. In the embodiment of FIG. 8, the inner ends 107', 109' of the support bars are formed as bifurcated forks for placement against the bars of the fourth X-member 26'.

Although the present invention has been described herein with respect to a preferred embodiment thereof, the foregoing description is intended to be illustrative, and not restrictive. Those skilled in the art will realize that many modifications of the preferred embodiment could be made which would be operable.

For example, although in the depicted embodiment, the braces 60, 61 are shown pivotally attached at the uppper ends 63, 65 thereof to the backrest support bars 56, 58, and are further shown slidably attached to a position fixing means including a rack gear on the pillars 52, 54 at the lower ends thereof, those in the art will realize and understand that the frame assembly 12 could be modified to form an equivalent structure (not shown) in which the connecting structure of the brace connections, to the respective pillar and backrest support members, was reversed top to bottom. In such a modified structure, a pivotal attachment of the braces could be provided to the pillars at the bottom ends thereof, and rack gears could also be mounted on the backrest support bars 56, 58. Furthermore in such an equivalent structure, the pawl 84 or pawls would be at the upper ends 63, 65 of the braces 60, 61, which would be slidably attached to the backrest support bars 56, 58 by sleeves or other equivalent structure.

Similarly, in a second type of modified equivalent structure (not shown), instead of the depicted sleeves 62, 64 shown slidably mounted on the outside of the pillars, equivalent sleeves and rack gears could be provided on the inside of hollow tubular pillars, with slots formed therein to allow the braces to connect to the inner sleeves and to move up and down on the pillars. These types of equivalent structures are within the contemplation and scope of the present invention. Indeed, all such modifications, which are within the scope of the claims, are intended to be within the scope and spirit of the present invention.

What is claimed is:

1. A folding chair which is collapsibly foldable from an open configuration thereof for supportively receiving a seated person therein, to a closed configuration thereof, said folding chair comprising:

a frame assembly, comprising:

a plurality of interconnected X-members which cooperate to define a cage when the chair is in the open configuration, each of said X-members comprising a pair of bars which are medially pivotally joined to one another;

at least one pillar which is operatively attached to said cage for substantially vertical placement when the chair is in the open configuration thereof, and a backrest support bar which is pivotally attached to the pillar;

position-fixing means for temporarily and disengagably fixing the position of the backrest support bar relative to the pillar;

and a fabric seat member which is mounted on and supported by the frame assembly.

2. The folding chair of claim 1, further comprising a foldably collapsible foot rest.

3. The folding chair of claim 1, wherein the fabric seat member comprises first and second arm rests, and wherein the frame assembly further comprises two opposed armrest support rails for supporting the fabric arm rests of the seat member.

4. The folding chair of claim 1, wherein the position fixing means comprises:

a brace having a first end which is pivotally attached to a first target member selected from the group consisting of the backrest support bar and the pillar, and a second end which is slidably movable along a second target member, which is the other member of said group, in response to pivotal movement of the backrest support bar.

5. The folding chair of claim 4, wherein the position fixing means further comprises a sleeve attached to the second end of the brace, a pawl which is pivotally attached to the sleeve, and a rack gear, having teeth formed therein, attached to said second target member;

wherein the pawl has a tip end which is placable between the teeth of the rack gear.

6. The folding chair of claim 5, further comprising a plastic liner which fits inside said sleeve, the liner being substantially C-shaped in cross section.

7. The folding chair of claim 1, wherein said at least one pillar is a first pillar, and wherein the frame assembly further comprises a second pillar, said first and second pillars being attached to rear corners of the cage, wherein said backrest support bar is a first backrest support bar, and wherein the frame assembly further comprises a second backrest support bar, said first and second backrest support bars being pivotally attached to upper ends of the respective first and second pillars, and wherein the frame assembly further comprises first and second braces adjustably attached to the respective first and second backrest support bars.

8. The folding chair of claim 7, wherein the frame assembly further comprises a bridge piece for interconnecting the upper ends of the first and second backrest support bars.

9. A folding chair which is foldably collapsible from an open configuration thereof for supportively receiving a seated person therein, to a closed configuration thereof, said folding chair comprising:

a frame assembly, comprising;

first, second, third and fourth X-members which cooperate to define a cage when the chair is in the open configuration thereof, each of said X-members comprising a pair of bars which are medially pivotally joined to one another for supporting a fabric seat member thereon;

first, second, third and fourth feet for supportively connecting adjacent lower ends of said X-members, each of said feet having two lower bar ends of selected X-members being pivotally attached thereto, wherein said first and second feet respectively define left and right lower rear corners of said cage, and wherein said third and fourth feet respectively define left and right lower front corners of said cage when the chair is in its open configuration;

first, second, third and fourth connector members for supportively connecting adjacent upper ends of said X-members, each of said connector members having two upper bar ends of selected X-members being pivotally attached thereto, wherein each of said first, second, third and fourth connector members is disposed over and above its correspondingly numbered foot when said chair is in its open configuration, and wherein said first and second connector members each have a cylindrical bore formed substantially vertically therethrough;

a first pillar attached to the third foot and extending upwardly therefrom for substantially vertical placement when said chair is in the opened configuration, said first pillar passing through the cylindrical bore of the first connector member;

a second pillar attached to the second foot and extending upwardly therefrom for substantially vertical placement when the chair is in the opened configuration, said second pillar passing through the cylindrical bore of the second connector member;

a first backrest support bar pivotally attached to the top of the first pillar, and a second backrest support bar pivotally attached to the top of the second pillar;

position fixing means for temporarily and disengagably fixing the position of the backrest support bars relative to the first and second pillars; the position fixing means comprising first and second braces, each having an upper end which is pivotally attached to the respective first or second backrest support bar, and a lower end which is slidably movable along the respective pillar in response to pivotal movement of the backrest support bar; and a fabric seat member which is mounted on and supported by the frame assembly.

10. The folding chair of claim 9, wherein the position fixing means further comprises a sleeve attached to the lower end of each of the first and second brace, a pawl which is pivotally attached to each of the sleeves, and a rack gear, having teeth formed therein, attached to each of said first and second pillars;

wherein each of the pawls has a tip end which is placable between the teeth of the respective corresponding rack gear.

11. The folding chair of claim 10, further comprising a plastic liner which fits inside each of said sleeves, the liner being substantially C-shaped in cross section.

12. The folding chair of claim 9, wherein the frame assembly further comprises a bridge piece for interconnecting the upper ends of the first and second backrest support bars.

13. A folding chair which is collapsibly foldable from an open configuration thereof, the folding chair comprising:

a fabric seat member for supporting a load thereon, and a frame assembly connected to and supporting the fabric seat member, the frame assembly comprising:

a plurality of interconnected X-members which cooperate to define a cage when the chair is in the open configuration, each of the X-members comprising a pair of bars which are medially pivotally joined to one another;

at least one pillar operatively attached to the cage, for substantially vertical placement when the chair is in the open configuration thereof, and a backrest support which is pivotally attached to an upper end of the pillar; and position fixing hardware for temporarily and releasably fixing the position of the backrest support in relation to the pillar.

14. The folding chair of claim 13, wherein a first end of a brace is pivotally connected to the backrest support, and further wherein the brace adjustably reinforces the backrest support, to allow a user to selectively recline the chair.

15. The folding chair of claim 13, wherein the frame assembly further comprises arm rest frame members integrally attached to each bar of a selected one of the X-members, and wherein the fabric seat member includes arm rests.

16. The folding chair of claim 13 further comprising a foldably collapsible foot rest.

17. The folding chair of claim 13, wherein said frame assembly comprises a brace having a first end which is pivotally connected to a first member selected from a target group consisting of the backrest support and the pillar; the brace further having a second end opposite the first end; and wherein the position fixing hardware is operable to temporarily and releasably fix the second end of the brace in relation to a second member of said target group.

* * * * *